US008646224B2

(12) United States Patent
Wurth

(10) Patent No.: US 8,646,224 B2
(45) Date of Patent: Feb. 11, 2014

(54) CONSTRUCTION APPARATUS

(75) Inventor: Steven P. Wurth, Sylvania, OH (US)

(73) Assignee: Wurtec Elevator Products & Services, Toledo, OH (US)

( * ) Notice: Subject to any disclaimer, the term of this patent is extended or adjusted under 35 U.S.C. 154(b) by 935 days.

(21) Appl. No.: 12/560,468

(22) Filed: Sep. 16, 2009

(65) Prior Publication Data

US 2010/0068005 A1 Mar. 18, 2010

Related U.S. Application Data

(60) Provisional application No. 61/097,657, filed on Sep. 17, 2008.

(51) Int. Cl.

| | |
|---|---|
| ***E02D 35/00*** | (2006.01) |
| ***E04G 21/14*** | (2006.01) |
| ***E04H 12/34*** | (2006.01) |
| ***E04H 9/06*** | (2006.01) |
| ***B66B 9/00*** | (2006.01) |

(52) U.S. Cl.
USPC ..... 52/125.2; 52/30; 182/128; 187/240; 187/379; 187/900

(58) Field of Classification Search
USPC ..... 52/125.2, 30; 182/45, 128, 82; 187/240, 187/401, 379, 900
See application file for complete search history.

(56) References Cited

U.S. PATENT DOCUMENTS

| | | | | |
|---|---|---|---|---|
| 434,701 | A | | 8/1890 | Conway |
| 983,578 | A | | 2/1911 | Stresenreuter |
| 1,745,045 | A | | 1/1930 | Romine |
| 2,431,194 | A | | 11/1947 | O'Brien |
| 2,531,930 | A | | 11/1950 | Woolslayer et al. |
| 2,569,821 | A | | 10/1951 | Maxeiner |
| 3,085,785 | A | | 4/1963 | Peterson |
| 3,463,334 | A | | 8/1969 | Blakely et al. |
| 3,513,987 | A | | 5/1970 | Seyff |
| 4,122,916 | A | * | 10/1978 | Strobel ..... 182/82 |
| 4,125,174 | A | * | 11/1978 | Lienhard ..... 182/128 |
| 4,270,628 | A | | 6/1981 | Anderson |
| 4,560,074 | A | | 12/1985 | Manning |
| 4,600,086 | A | | 7/1986 | Yamasaki et al. |
| 4,621,741 | A | | 11/1986 | Boon |
| 5,417,018 | A | | 5/1995 | Matsumoto et al. |
| 5,622,237 | A | | 4/1997 | Moldow |
| 6,880,678 | B1 | * | 4/2005 | Schneider et al. ..... 187/314 |
| 7,044,313 | B2 | | 5/2006 | Haliburda, III |

(Continued)

FOREIGN PATENT DOCUMENTS

FR 2641018 A1 * 12/1988 ..... E04G 3/06

*Primary Examiner* — Andrew Triggs
(74) *Attorney, Agent, or Firm* — Fraser Clemens Martin & Miller LLC; Charles F. Charpie

(57) ABSTRACT

Construction apparatus for use within an elevator hoistway are provided. The construction apparatus include a span member having a first end and a second end. A sill attachment is connected to the first end of the span member and configured to seat against a building sill. A support member is connected to the second end of the span member and configured to seat against a second side of the elevator hoistway, wherein the second side of the elevator hoistway is opposite the building sill. A plurality of apertures is arranged on the span member and configured to allow a connection to a hoist device. The span member is configured to rotate about the sill attachment.

20 Claims, 6 Drawing Sheets

(56) References Cited

U.S. PATENT DOCUMENTS 7,108,100 B2 * 9/2006 Stingl ..... 182/82
7,137,485 B2 * 11/2006 Barneman et al. ..... 187/408
7,559,409 B2 * 7/2009 Barneman et al. ..... 187/408
2010/0068005 A1 * 3/2010 Wurth ..... 414/10
2011/0024231 A1 * 2/2011 Wurth et al. ..... 182/113

* cited by examiner

CONSTRUCTION APPARATUS

CROSS REFERENCE TO RELATED APPLICATIONS

This application claims the benefit of U.S. Provisional Application No. 61/097,657, filed Sep. 17, 2008, the disclosure of which is incorporated herein by reference.

BACKGROUND

Structures, such as commercial buildings, can be built using a variety of construction materials and construction processes. One example of a common construction material is concrete. Buildings built from concrete can have many building floors and can be constructed very quickly. In some cases, the build-out of the lower building floors is started prior to the construction of the upper building floors. In these cases, various construction activities, such as for example, running of plumbing pipes, installation of electrical wires and installation of elevator guide rails, can occur prior to the construction of the upper building floors.

The various construction activities often require heavy construction materials, such as for example pipes, panels, wires and guide rails to be installed on building floors above the first floor. Because the upper floors have not been completed, the elevators within the building are not available for use in transporting the heavy construction materials. In the construction of some buildings, the use of a crane for hoisting heavy construction materials it is not cost-effective or efficient.

It would be advantageous to provide a construction apparatus that could be easily used within an elevator hoistway for hoisting construction materials.

SUMMARY

In accordance with embodiments of this invention there are provided construction apparatus for use within an elevator hoistway. The construction apparatus include a span member having a first end and a second end. A sill attachment is connected to the first end of the span member and configured to seat against a building sill. A support member is connected to the second end of the span member and configured to seat against a second side of the elevator hoistway, wherein the second side of the elevator hoistway is opposite the building sill. A plurality of apertures is arranged on the span member and configured to allow a connection to a hoist device. The span member is configured to rotate about the sill attachment.

In accordance with other embodiments, there are also provided methods of using construction apparatus within an elevator hoistway. The methods include the steps of providing a construction apparatus having a span member and a sill attachment connected to a first end of the span member, the span member having a second end connected to a support member, a plurality of apertures arranged on the span member, the span member being configured to rotate about the sill attachment, seating a sill attachment against a building sill, rotating the construction apparatus about the sill attachment toward an opposing second side of the elevator hoistway, seating the support member against the second side of the hoistway; and connecting a hoist device to the plurality of apertures such that materials can be hoisted within the elevator hoistway.

In accordance with other embodiments, there are also provided construction apparatus for use within an elevator hoistway. The construction apparatus include a span member having a first end and a second end. A sill attachment is connected to the first end of the span member and configured to seat against a building sill. A support member is connected to the second end of the span member and configured to seat against a second side of the elevator hoistway, wherein the second side of the elevator hoistway is opposite the building sill. A plurality of apertures are arranged on the span member and configured to allow a connection to a hoist device. A plurality of forms is connected to the span member and a plurality of platforms is supported by the plurality of forms, the platforms being configured to provide a working platform within the elevator hoistway. The span member is configured to rotate about the sill attachment.

Various advantages of this invention will become apparent to those skilled in the art from the following detailed description of the invention, when read in light of the accompanying drawings.

DETAILED DESCRIPTION OF THE INVENTION

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

In accordance with embodiments of the present invention, apparatus for hoisting construction materials within an elevator hoistway are provided. It will be understood the term "structure", as used herein, is defined to mean any permanently enclosed construction having more than one floor. The term "hoistway" as used herein, is defined to mean the vertical space within which an elevator travels. The term "hoisting", as used herein, is defined as the act of moving objects, groups of objects or materials from one height within a structure to another height.

The description and figures disclose apparatus for hoisting construction materials within an elevator hoistway. The apparatus are useful with any material that can be hoisted. Also conventional and well-known techniques are not illustrated.

Figure 1:
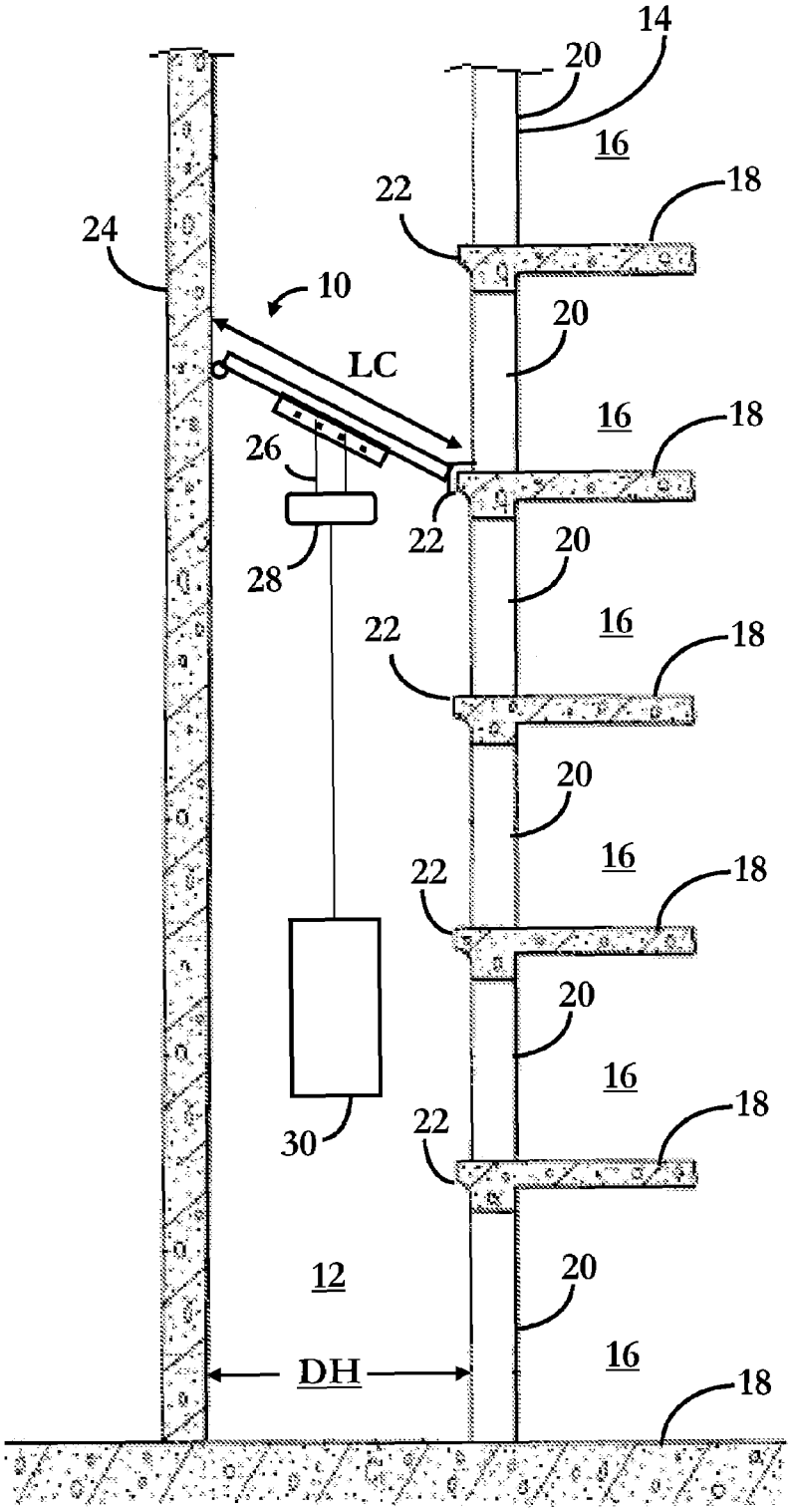
FIG. 1 is a schematic side view in elevation of a first embodiment of a construction apparatus used within an elevator hoistway.

Referring now to the drawings, there is illustrated in FIG. 1 a first embodiment of a construction apparatus, indicated generally at 10, for use within an elevator hoistway 12 of a building 14 that is conventional in the art.

As shown in FIG. 1, the building 14 includes a plurality of building floors 16. While the building 14 illustrated in FIG. 1 is shown having six building floors 16, it should be understood that the building 14 can have more or less than six building floors 16. Each building floor 16 includes a floor pad 18, an elevator entrance 20 and an entrance sill 22. The floor pad 18 provides a working surface for each building floor 16. In the illustrated embodiment, the floor pad 18 is constructed of reinforced concrete and has a thickness of approximately 10.0 inches. However, the floor pad 18 can be constructed of any appropriate material or materials, such as for example building steel, and can have a thickness of more or less than 10.0 inches.

The elevator entrance 20 separates the building floor 16 from the elevator hoistway 12 and provides an opening through which passengers can enter an elevator (not shown). The elevator entrance 20 can have any desired size, shape, thickness, and configuration.

The entrance sill 22 is a portion of the floor pad 18 and is positioned at the intersection of the floor pad 18 and the elevator hoistway 12. In the embodiment illustrated in FIG. 2, the upper end of the entrance sill 22 facing the elevator hoistway 12 forms a corner. However, the upper end of the entrance sill 22 facing the elevator hoistway 12 can form other desired shapes, such as for example a rounded edge.

Referring again to FIG. 1, the elevator hoistway 12 is bounded on one side by the plurality of elevator entrances 20 and on the other side by a hoistway wall 24. The hoistway wall 24 extends from the bottom of the hoistway 12 to the top of the hoistway 12. In the illustrated embodiment, the hoistway wall 24 is constructed of reinforced concrete and has a thickness of approximately 10.0 inches. However, the hoistway wall 24 can be constructed of any appropriate materials, such as for example concrete block, and can have a thickness of more or less than 10.0 inches. In the illustrated embodiment, the hoistway wall 24 has no openings along its height. However, the hoistway wall 24 can have any desired quantity of openings positioned at any desired location along its height.

The elevator hoistway 12 has a horizontal distance DH extending from the hoistway wall 24 to the elevator entrance 20. In the illustrated embodiment, the horizontal distance DH is approximately 8.0 feet. However, the horizontal distance DH can be more or less than approximately 8.0 feet.

Referring again to FIG. 1, it can be seen that the construction apparatus 10, oriented in an inclined position, is configured to span the horizontal distance DH of the elevator hoistway 12, with one end of the construction apparatus 10 seated against the entrance sill 22 and the other end of the construction apparatus 10 seated against the hoistway wall 24. The construction apparatus 10 has a length LC that is longer than the horizontal distance DH of the elevator hoistway 12, thereby ensuring the construction apparatus 10 rests on an inclined orientation.

At least one support 26 is connected to the construction apparatus 10. The support 26 is configured to connect a hoist device 28 to the construction apparatus 10. In the illustrated embodiment, the at least one support 26 is made of a metal rope. However, the support 26 can be made of other materials or components, such as for example chain or straps, sufficient to connect the hoist device 28 to the construction apparatus 10. In other embodiments, other suitable components, devices or mechanisms, such as for example safety harnesses or safety lines, may be connected to the at least one support 26.

The hoist device 28 can be configured to hoist a load 30 from one level of the building, such as the ground building floor, to another level of the building, such as an upper building floor. In the illustrated embodiment, the hoist device 28 is any suitable mechanism or device, such as an electrical hoist, a manual hoist, a lever hoist, or a chain fall, sufficient to hoist a load 30 from one floor 16 of the building 14 to another floor 16 of the building 14. The load 30 can be any construction material, construction tool, or object desired at an upper or lower level of the building 14.

Figure 2:
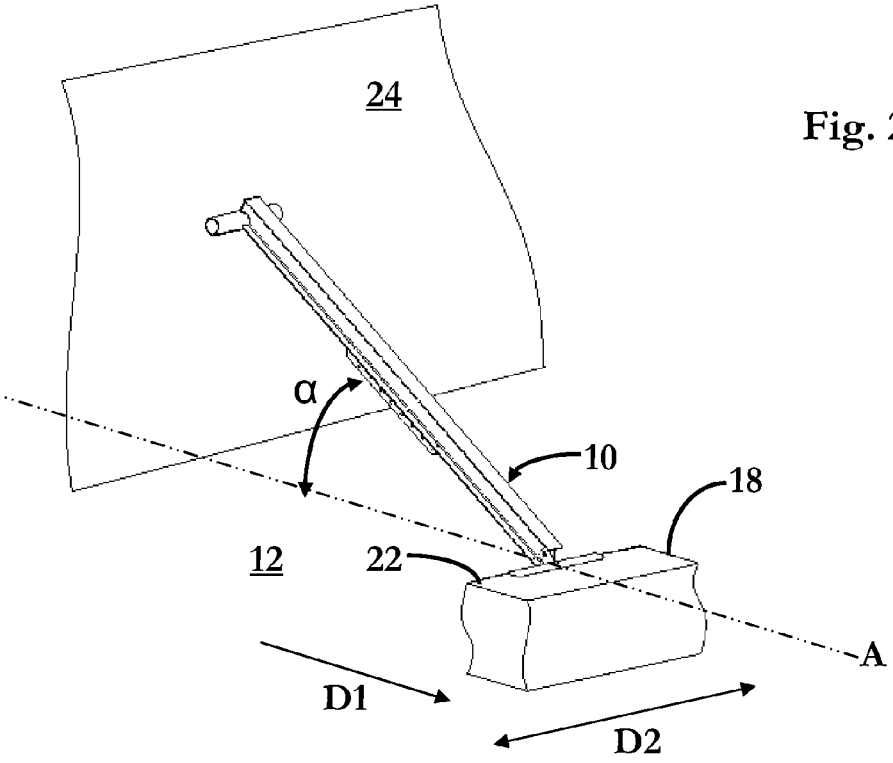
FIG. 2 is a perspective view of the first embodiment of the construction apparatus illustrated in FIG. 1.

Referring now to FIG. 2, the construction apparatus 10 is shown with a first end of the construction apparatus 10 seated against the entrance sill 22 and the other end of the construction apparatus 10 seated against the hoistway wall 24. As discussed above, the construction apparatus 10 rests on an inclined orientation with respect to a substantially horizontal axis A. Axis A is defined as a line perpendicular to the hoistway wall 24 and parallel to the floor pad 18. In the inclined position, the construction apparatus 10 forms an angle $\alpha$ with axis A. Angle $\alpha$ prevents the construction apparatus 10 from falling down the hoistway. In the illustrated embodiment, angle $\alpha$ is approximately 30°. However, angle $\alpha$ can be in a range of from about 20° to about 70°.

Figure 3:
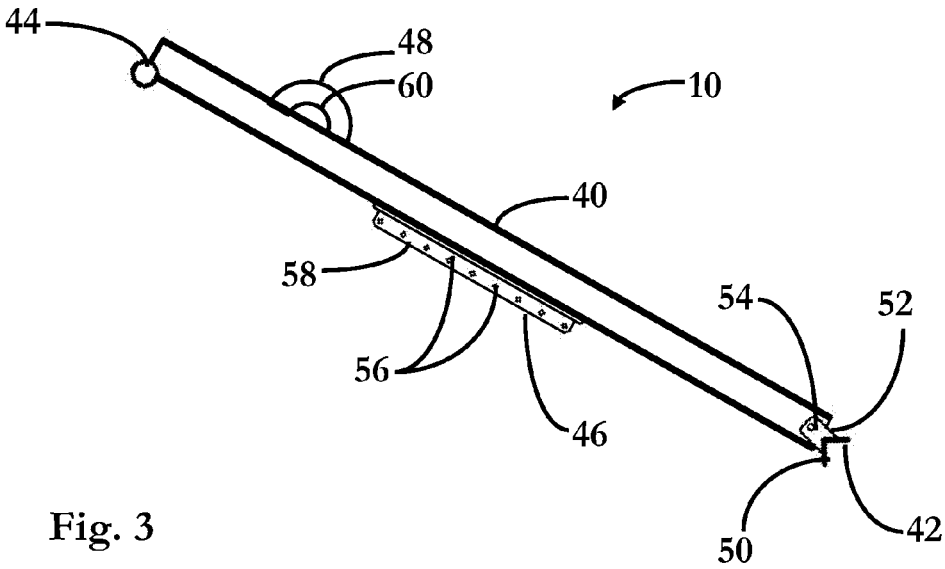
FIG. 3 is a side view in elevation of the embodiment of the construction apparatus illustrated in FIGS. 1 and 2.

Referring now to FIG. 3, the construction apparatus 10 includes span member 40, a sill attachment 42, a support member 44, a lift bar 46 and an optional lift lug 48. The span member 40 is a structural member configured to span the horizontal distance DH of the elevator hoistway and support the weight of the hoist device 28 and the load 30. In the illustrated embodiment, the span member 40 is a beam having a cross-sectional shape of an "I". However, the span member 40 can have other cross-sectional shapes, such as for example square, rectangular, circular, channel, "H" shape, "L" shape, "T" shape or "W" shape, sufficient to span the horizontal distance DH of the elevator hoistway and support the weight of the hoist device 28 and the load 30. As shown in FIG. 3, the span member 40 is made of structural steel. However, the span member 40 can be made of other materials, such as for example aluminum, sufficient to span the horizontal distance DH of the elevator hoistway and support the weight of the hoist device 28 and the load 30.

The sill attachment 42 is connected to one end of the span member 40. The sill attachment 42 is configured to seat against the entrance sill 22 and allow the span member 40 to pivot. The sill attachment 42 includes a sill member 50 and an extension member 52. The sill member 50 is configured to seat against the entrance sill 22. The sill member 50 is further configured to prevent movement of the construction apparatus 10 in a first direction D1, away from the hoistway wall 24, and also prevent the movement of the construction apparatus in a second direction D2, along the edge of the entrance sill 22 as shown in FIG. 2. In the illustrated embodiment, the sill member 50 has an "L" cross sectional shape configured to seat against the corner shape of the entrance sill 22. However, the sill member 50 can have other desired cross-sectional shapes sufficient to seat against the entrance sill 22.

Referring again to FIG. 3, the sill member 50 is made of steel. However, the sill member 50 can be made of other desired materials, such as for example aluminum, sufficient to seat against the entrance sill 22 and prevent the movement of the construction apparatus 10 in directions D1 and D2. In some embodiments, the inside surfaces of the sill member 50 may have a layer of slip resistant material or have a coating of slip resistant material.

Referring again to FIG. 3, the sill member 50 is connected to the extension member 52. The extension member 52 is configured to connect the sill member 50 to the span member 40 such that the sill attachment 42 can rotate around pivot point 54. In the illustrated embodiment, the extension member 52 is a steel bar. However, the extension member 52 can be any structure, mechanism, or device, such as for example a link, sufficient to connect the sill member 50 to the span member 40 such that the sill attachment 42 can rotate around pivot point 54.

The support member 44 is connected to the other end of the span member 40. The support member 44 is configured to seat against the hoistway wall 24 and provide support for the construction apparatus 10 at the desired angle $\alpha$. In the illustrated embodiment, the support member 44 is made from steel pipe, having a round cross-sectional shape, welded to the span member 40 and mounted in a direction perpendicular to the longitudinal axis of the span member 40. However, the support member 44 can be made from other desired materials, such as for example aluminum, and can have other cross-sectional shapes, such as for example an octagonal cross-sectional shape. Additionally, the support member 44 can be connected to the span member 40 by other desired methods, such as for example adhesives, clamps, or clips sufficient to rest against the hoistway wall 24 and provide support for the construction apparatus 10 at the resulting angle $\alpha$. In yet other embodiments, the end of the span member 40 positioned against the hoistway wall 24 can include other structures, mechanisms or devices, such as for example pivoting angles or spring-loaded members, sufficient to seat against the hoistway wall 24 and provide support for the construction apparatus 10 at the desired angle $\alpha$. In some embodiments, the outside surface of the support member 44 may have a layer of slip resistant material or have a coating of slip resistant material.

Referring again to FIG. 3, the lift bar 46 is connected to the span member 40. The lift bar 46 is configured to provide a plurality of apertures or "pick points" 56 for the supports 26 connected to the hoist device 28. As shown in FIG. 3, the lift bar 46 is substantially centered along the longitudinal axis of the construction apparatus 10. However, the lift bar 46 can be positioned at other longitudinal locations along the construction apparatus 10. In the illustrated embodiment, the lift bar 46 comprises a member 58 having the plurality of apertures 56. The member 58 is connected to the span member 40 in any suitable manner, such as for example by welding. The apertures 56 are configured for connection to the supports 26. While FIG. 3 illustrates a single lift bar 46, it should be understood that more than one lift bar 46 can be provided. The apertures 56 can have any shape, such as for example slots, sufficient to allow connection to the supports 26.

As shown in FIG. 3, the optional lift lug 48 is connected to the construction apparatus 10. The lift lug 48 is configured to allow the construction apparatus 10 to be hoisted by hoist devices (not shown) to other locations within the elevator hoistway 12. In the illustrated embodiment, the lift lug 48 is formed to provide a lift aperture 60. However, the lift lug 48 can be other structures, shapes or devices, suitable to allow the construction apparatus 10 to be hoisted by hoist devices to other locations within the elevator hoistway 12. In operation, as the construction apparatus 10 is hoisted to other locations in the elevator hoistway 12, the lift lug 48 allows the construction apparatus 10 to rotate to a substantially vertical position thereby allowing the construction apparatus 10 to be hoisted without interfering with structures or equipment in the elevator hoistway 12.

In some circumstances, the construction apparatus 10 including the component parts of the span member 40, sill attachment 42, support member 44, lift bar 46 and optional lift lug 48, may be exposed to the weather. Accordingly, the construction apparatus 10 and the component parts may have a suitable corrosion or oxidation preventative finish. Examples of suitable corrosion or oxidation preventative finishes include corrosion inhibiting paints, zinc chromate and cadmium plating.

Figure 4:
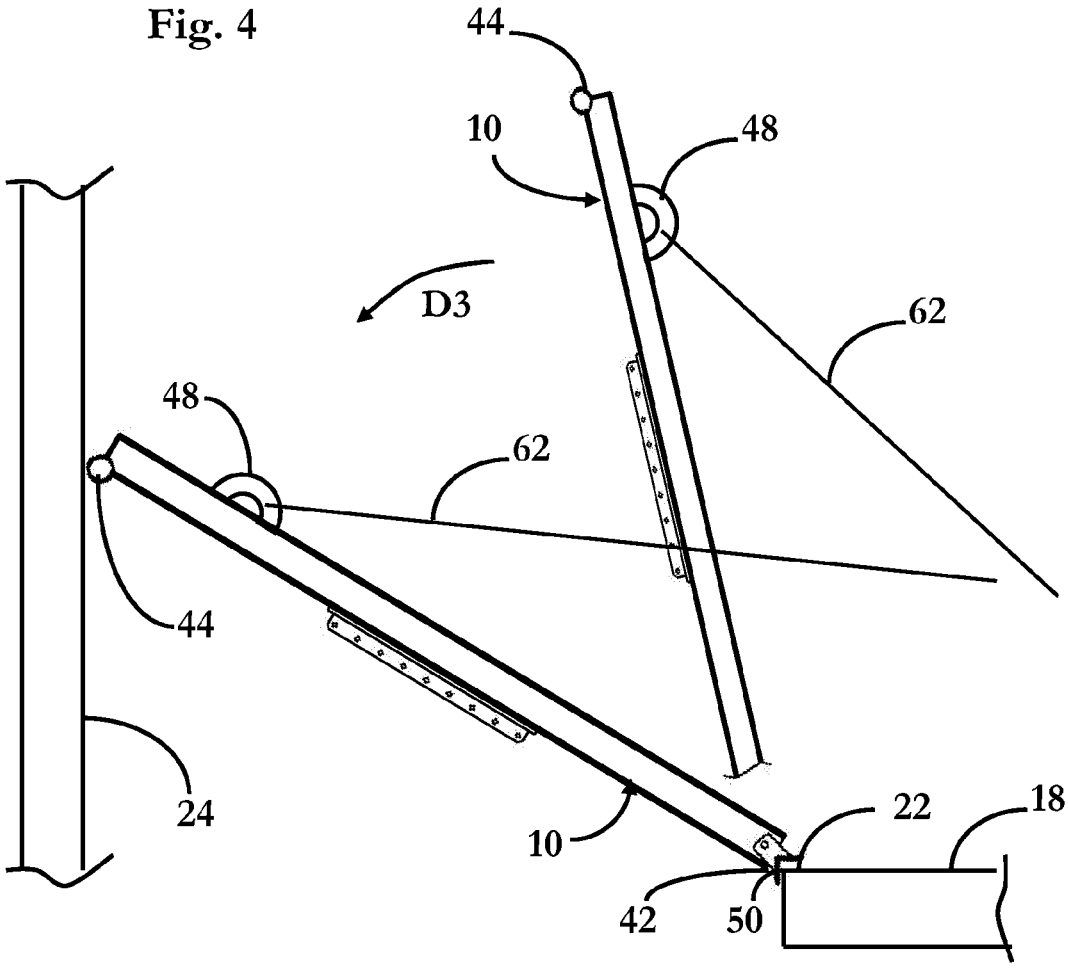
FIG. 4 is a side view in elevation illustrating the operation of the first embodiment of the construction apparatus.

Referring now to FIG. 4, the positioning and operation of the construction apparatus 10 will be described. Initially, the operator connects a line 62 to the optional lift lug 48. Next, the operator seats the sill member 50 of the sill attachment 42 against the entrance sill 22. As shown in FIG. 4, the construction apparatus 10 is in a substantially vertical initial position. Next, the end of the construction apparatus 10 opposite the sill attachment 42 is rotated toward the hoistway wall 24, in direction D3, as the operator maintains tension in the line 62. The end of the construction apparatus 10 opposite the sill attachment 42 continues to rotate toward the hoistway wall 24 until the support member 44 seats against the hoistway wall 24. Once the construction apparatus 10 is positioned such that the support member 44 is seated against the hoistway wall 24 and the sill member 50 is seated against the entrance sill 22, the construction apparatus 10 is in position for use as described above.

Figure 5:
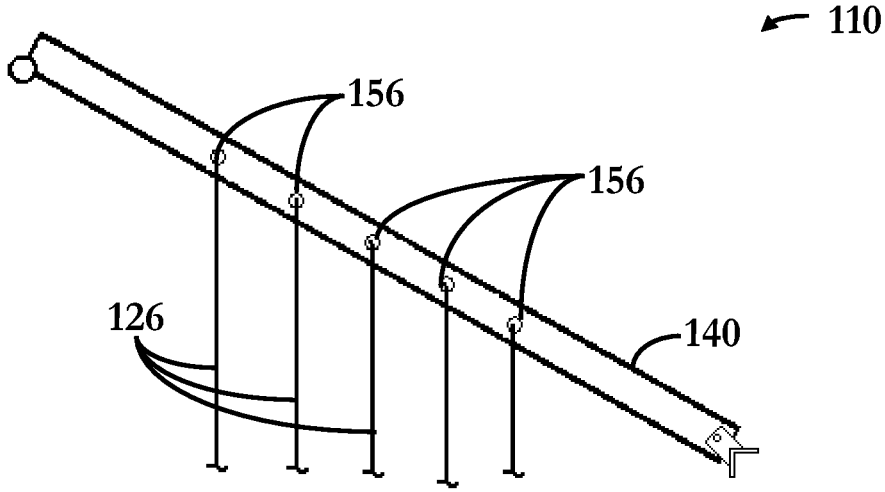
FIG. 5 is a side view in elevator of a second embodiment of the construction apparatus.

A second embodiment of a construction apparatus 110 is shown in FIG. 5. In this embodiment, the lift bar is omitted and apertures 156 configured for connection to supports 126 are formed integral to the span member 140. In this embodiment, the apertures 156 and the supports 126 are the same as or similar to the apertures 56 and the supports 26 described above and illustrated in FIG. 3. The apertures 156 can have any shape, such as for example slots, sufficient to allow connection to the supports 126. While the illustrated embodiment includes a quantity of five apertures 156, it should be appreciated that any desired quantity of apertures 156 can be used. While the illustrated embodiment shows the apertures 156 as spaced apart an equal distance and centered along the length of the construction apparatus 110, it should be appreciated that in other embodiments, the apertures 156 can have any desired spacing and can be positioned at any desired location along the length of the construction apparatus 110.

Figure 6:
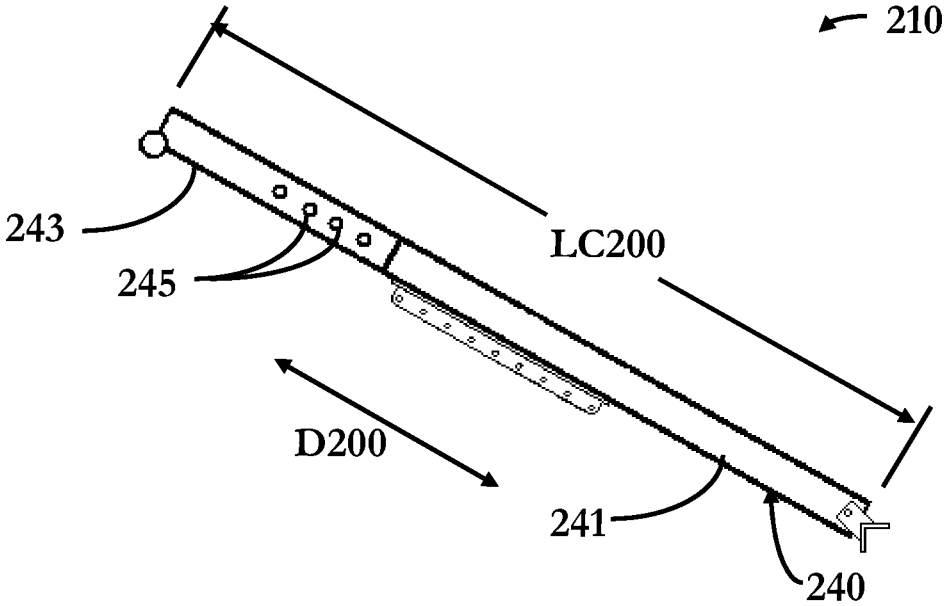
FIG. 6 is a side view in elevation of a third embodiment of the construction apparatus.

A third embodiment of a construction apparatus 210 is shown in FIG. 6. In this embodiment, span member 240 includes a first portion 241 and a second portion 243. The first portion 241 and the second portion 243 are configured to move axially, in direction D200, with respect to each other such that an overall length LC200 of the construction apparatus 210 can be made longer or shorter. By making the overall length LC200 of the construction apparatus 210 adjustable, the construction apparatus 210 can accommodate elevator hoistways having different horizontal distances DH. Once the desired overall length LC200 of the construction apparatus 210 is achieved, the first portion 241 and the second portion 243 are connected to each other with a plurality of fastenings 245. The fastenings 245 can be any desired fastening mechanisms, such as for example nuts and bolts, clips or clamps, sufficient to connect the first portion 241 to the second portion 243. In the illustrated embodiment, the first and second portions, 241 and 243, are overlapping structural members, such as for example overlapping angle iron. However, the first and second portions, 241 and 243, can be other structural members, connected in other arrangements, such as for example, channels positioned back to back, or telescoping tubes.

Figure 7:
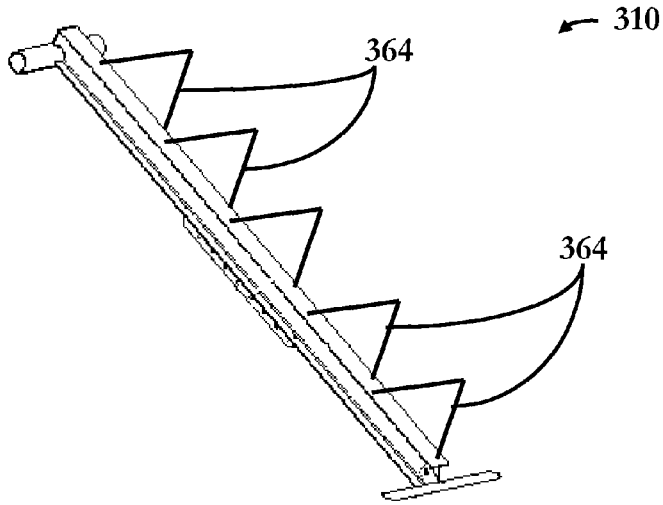
FIG. 7 is a perspective view of a fourth embodiment of the construction apparatus.
Figure 8:
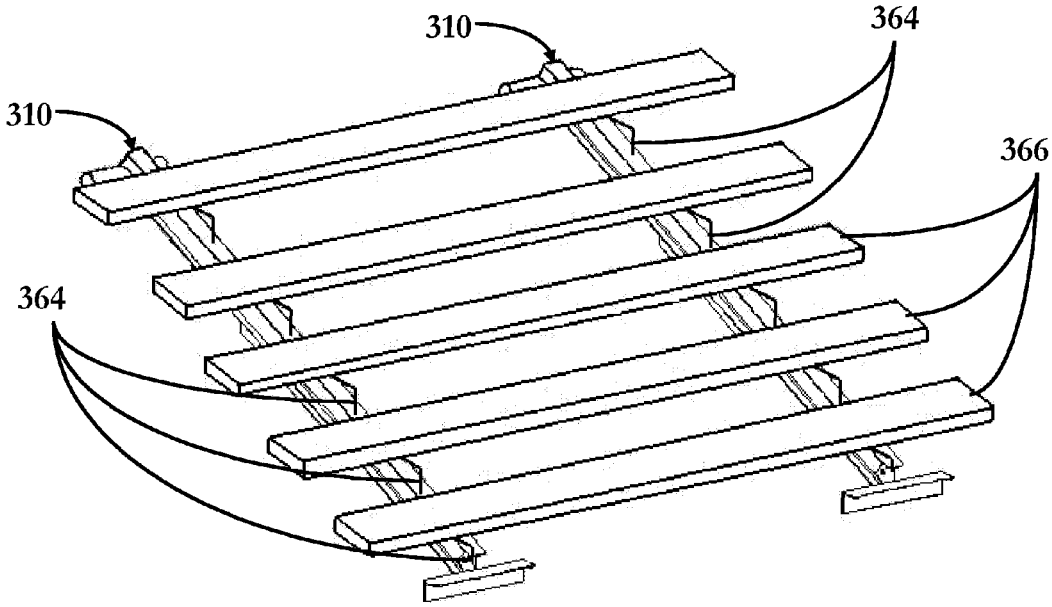
FIG. 8 is a perspective view illustrating the operation of the fourth embodiment of the construction apparatus.

A fourth embodiment of a construction apparatus 310 is shown in FIGS. 7 and 8. In this embodiment, at least one construction apparatus 310 is used to span an elevator hoistway as described above, and the construction apparatus 310 is configured to provide the basis for a working platform within the elevator hoistway. Referring first to FIG. 7, the construction apparatus 310 is fitted with a plurality of forms 364. The forms 364 can be made of any desired material, such as for example steel or aluminum, and can be fitted to the construction apparatus 310 in any desired manner, such as for example welding or mechanical fastenings. Referring now to FIG. 8, a quantity of two construction apparatus 310 are positioned in the elevator hoistway such that the forms 364 provide support for a plurality of platforms 366. The platforms 366 are configured to provide a stable and substantially level working surface within the elevator hoistway. The platforms 366 can be formed from any desired material, such as for example wooden boards. While the embodiment shown in FIG. 8 illustrates the use of two construction apparatus 310 to provide the basis for a working platform, it should be understood that any desired number of construction apparatus 310 can be used. Additionally, while the embodiment shown in FIGS. 7 and 8 illustrate a quantity of five forms 364 fitted to the construction apparatus 310, it should be understood than any desired number of forms 364 and any desired number of platforms 366 can be used. While the construction apparatus 310 and platforms 366 illustrated in FIG. 8 provide a working surface, it should be understood that the construction apparatus 310 and platforms 366 advantageously also provide protection from objects falling from overhead within the elevator hoistway.

Figure 9:
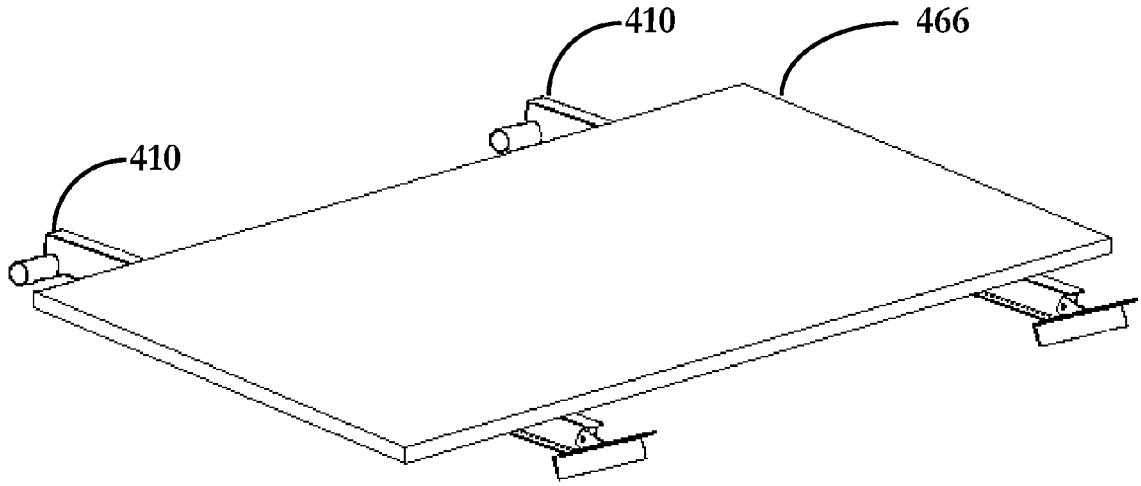
FIG. 9 is a perspective view illustrating the operation of a fifth embodiment of the construction apparatus.

A fifth embodiment of a construction apparatus 410 is shown in FIG. 9. In this embodiment, the construction apparatus 410 are used to span an elevator hoistway and provide the basis for a working platform within the elevator hoistway. However in this embodiment, the construction apparatus 410 is not fitted with forms 364 as shown in FIGS. 7 and 8. Rather, the construction apparatus 410 is adjusted to span the elevator hoistway such that a platform 466 can be positioned on the top surfaces of the construction apparatus 410. Used in this manner, the construction apparatus 410 provide a substantially stable level working surface within the elevator hoistway. While the construction apparatus 410 and platform 466 illustrated in FIG. 9 provide a working surface, it should be understood that the construction apparatus 410 and platform 466 advantageously also provide protection from objects falling from overhead within the elevator hoistway.

The principle and mode of operation of this invention have been described in its preferred embodiments. However, it should be noted that this invention may be practiced otherwise than as specifically illustrated and described without departing from its scope.

What is claimed is:

1. A construction apparatus for use within an elevator hoistway, the construction apparatus comprising:

a span member having a first end and a second end, wherein the span member has a length;

a sill attachment connected to the first end of the span member and configured to seat against a building sill;

a support member connected to the second end of the span member and configured to seat against a second side of the elevator hoistway, wherein the second side of the elevator hoistway is opposite the building sill; and a plurality of apertures arranged on the span member and configured to allow a connection to a hoist device;

wherein the span member is configured to rotate about the sill attachment and wherein the length of the span member is longer than a horizontal distance from the building sill to the second side of the elevator hoistway such that when the support member is seated against the second side of the elevator hoistway and the sill attachment is seated against the building sill, the construction apparatus rests in an inclined orientation with respect to a substantially horizontal axis.

2. The construction apparatus of claim 1, wherein when the support member is seated against the second side of the elevator hoistway and the sill attachment is seated against the building sill, the construction apparatus forms an angle with a substantially horizontal axis, and wherein the angle is in a range of from about 20° to about 70°.

3. The construction apparatus of claim 1, wherein the span member includes a lift lug.

4. The construction apparatus of claim 3, wherein the lift lug is configured to form a lift aperture, and wherein the lift aperture is configured to allow the construction apparatus to be hoisted by hoist devices to other locations.

5. The construction apparatus of claim 4, wherein in operation as the construction apparatus is being hoisted by hoist devices to other locations, the construction apparatus is configured for rotation to a substantially vertical orientation.

6. The construction apparatus of claim 1, wherein the apertures are positioned in a lift bar, and the lift bar is connected to the span member.

7. The construction apparatus of claim 6, wherein the lift bar is substantially centered along the longitudinal axis of the span member.

8. The construction apparatus of claim 1, wherein the span member includes a first portion and a second portion, and wherein the first portion and the second portion are configured to move relative to each other thereby allowing adjustment of a length of the construction apparatus.

9. The construction apparatus of claim 8, wherein the relative movement of the first and second portions is in an axial direction.

10. The construction apparatus of claim 8, wherein the first and second portions overlap each other.

11. The construction apparatus of claim 1, wherein the second side of the elevator hoistway is a wall.

12. The construction apparatus of claim 1, wherein the span member is configured to support the weight of a hoist device and a hoisted load.

13. The construction apparatus of claim 1, wherein the span member has the cross-sectional shape of an "I".

14. The construction apparatus of claim 1, wherein the sill attachment is configured to allow the span member to pivot about the sill attachment.

15. The construction apparatus of claim 1, wherein the support member is mounted in a direction perpendicular to a longitudinal axis of the span member.

16. The construction apparatus of claim 1, wherein the second end of the construction apparatus is configured for attachment to a tensioning line.

17. The construction apparatus of claim 1, wherein the span member is fitted with a plurality of forms and a plurality of platforms.

18. The construction apparatus of claim 17, wherein the platforms are wooden boards.

19. The construction apparatus of claim 17, wherein a top surface of the span member is configured to receive a platform.

20. The construction apparatus of claim 17, wherein the plurality of forms and the plurality of platforms are supported by more than one span member.

* * * * *